United States Patent [19]

Erikson

[11] 4,127,194

[45] Nov. 28, 1978

[54] DEVICE FOR SORTING MAIL ACCORDING TO ZIP CODES

[75] Inventor: Rolf B. Erikson, Lincolnwood, Ill.

[73] Assignee: Bell & Howell Company, Chicago, Ill.

[21] Appl. No.: 784,407

[22] Filed: Apr. 4, 1977

[51] Int. Cl.[2] ..... B07C 5/342

[52] U.S. Cl. ..... 209/578; 118/8; 222/40

[58] Field of Search ..... 209/73, 74 R, 74 M, 209/111.5, 111.7 R, DIG. 1; 118/8; 101/2; 222/23, 40; 340/228 R, 239 R, 244 R

[56] References Cited

U.S. PATENT DOCUMENTS

| | | | |
|---|---|---|---|
| 2,904,174 | 9/1959 | Emerson | 209/111.7 R |
| 2,936,886 | 5/1960 | Harmon | 209/DIG. 1 |
| 3,090,870 | 5/1963 | Ruckert | 209/DIG. 1 |
| 3,105,908 | 10/1963 | Burkhardt et al. | 209/DIG. 1 |
| 3,682,131 | 8/1972 | Algeri et al. | 118/8 X |
| 3,839,636 | 10/1974 | Worrall | 209/DIG. 1 |
| 3,878,541 | 4/1975 | Dodson | 340/228 RX |
| 4,028,689 | 6/1977 | Schopp | 340/239 R |

*Primary Examiner*—Joseph J. Rolla

*Attorney, Agent, or Firm*—Harry G. Thibault; Alan B. Samlan

[57] ABSTRACT

A system for sorting mailing pieces is described in which pre-addressed labels are applied to mailing pieces and in which selected labels bearing indicia representative of a zip code group are selectively coated to identify them from labels not bearing such indicia. To distinguish coated labels from non-coated labels, each label is considered as having two or more portions, including a first coatable portion and a second reference portion. Only labels bearing zip code group indicia receive a coating on their coatable portions. Thereafter, each label is examined to detect the level of radiation, if any, emitted from its coatable and reference portions. If the level of radiation emitted from a coatable portion of a label exceeds the level of radiation emitted from its reference portion by at least a predetermined difference, such a label is identified as bearing indicia representative of a zip code group.

13 Claims, 15 Drawing Figures

DEVICE FOR SORTING MAIL ACCORDING TO ZIP CODES

BACKGROUND OF THE INVENTION

This invention is related generally to mail handling apparatus and particularly to such apparatus which applies pre-addressed labels to mailing pieces.

At the present time, the United States Postal Service requires that large users of mail package their mailing pieces according to zip codes to facilitate mail delivery. Accordingly, large mail order houses and the like which address their mailing pieces by applying thereto a pre-addressed label require that the labels be grouped according to zip codes. Typically, the labels are provided in a sheet on which labels bearing the same zip code are arranged together, with the first label of a new zip code group bearing an asterisk or other indicia indicative of a new zip code.

In applying the labels to mailing pieces, a sheet of labels is fed to a label head under which a conveyor moves the mailing pieces. The label head applies the labels to the mailing pieces which are then further conveyed to a mail handling station where the addressed mailing pieces are bundled according to zip codes.

To facilitate such bundling, prior label heads have included a sensor for detecting the asterisk or other indicia indicating a new zip code. The sensor in turn actuates a kicker or the like disposed downstream from the label head for skewing the mailing piece which bears the label on which the asterisk was sensed. An operator is thus provided with a visual indication that a new zip code group of mailing pieces is being conveyed.

Frequently, however, the bundling station may be located remotely from the label head, thereby making it impractical to activate a kicker located near the bundling station. Under these circumstances, it has been proposed that the asterisk sensor activate a coating device for coating the label bearing an asterisk with a radiation-emissive substance. The mailing pieces may then be carried or conveyed to the remote bundling station where a radiation detector will sense the presence of a coated label and, in response thereto, actuate a nearby kicker.

A problem which may arise with the latter arrangement is that the label material and/or the mailing piece to which a label is applied may have been previously treated during its manufacture with a dye which is radiation-emissive. As a result, the radiation detector is unable to reliably differentiate between mailing pieces bearing labels which were coated by the coating device and other labels. Consequently, the kicker may be actuated to skew the wrong mailing pieces.

An additional problem associated with mail handling apparatus using coating devices is that the substance issued by the coating device may not always be accurately deposited on a label when the speed of the conveyor which conveys the mailing pieces is varied. The subsequent detection of a label bearing the deposited substance is, therefore, made more difficult. These and other problems associated with some prior mail handling apparatus have resulted in less than optimum sorting of mailing pieces.

Accordingly, it is an object of this invention to provide an improved mail sorting system which overcomes the deficiencies associated with prior systems.

It is a more specific object of this invention to provide a mail sorting system wherein a radiation-emissive substance is more accurately coated on selected address labels and wherein the coated labels are reliably distinguished from non-coated labels.

These and other objects of the invention are more particularly set forth in the following detailed description and in the accompanying drawings of which:

Figure 1:
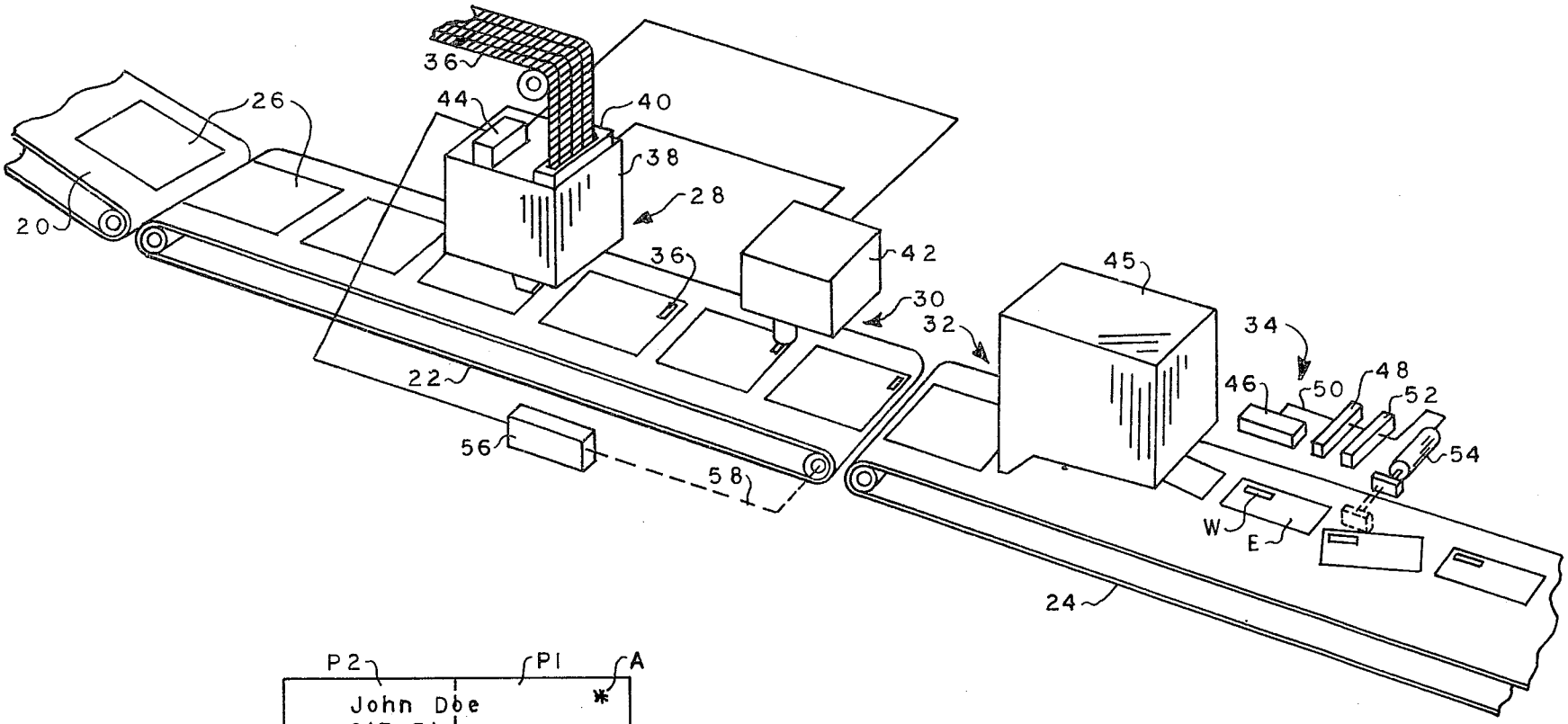
FIG. 1 is a perspective, schematic view of a mail sorting system embodying various aspects of this invention.
Figure 3:
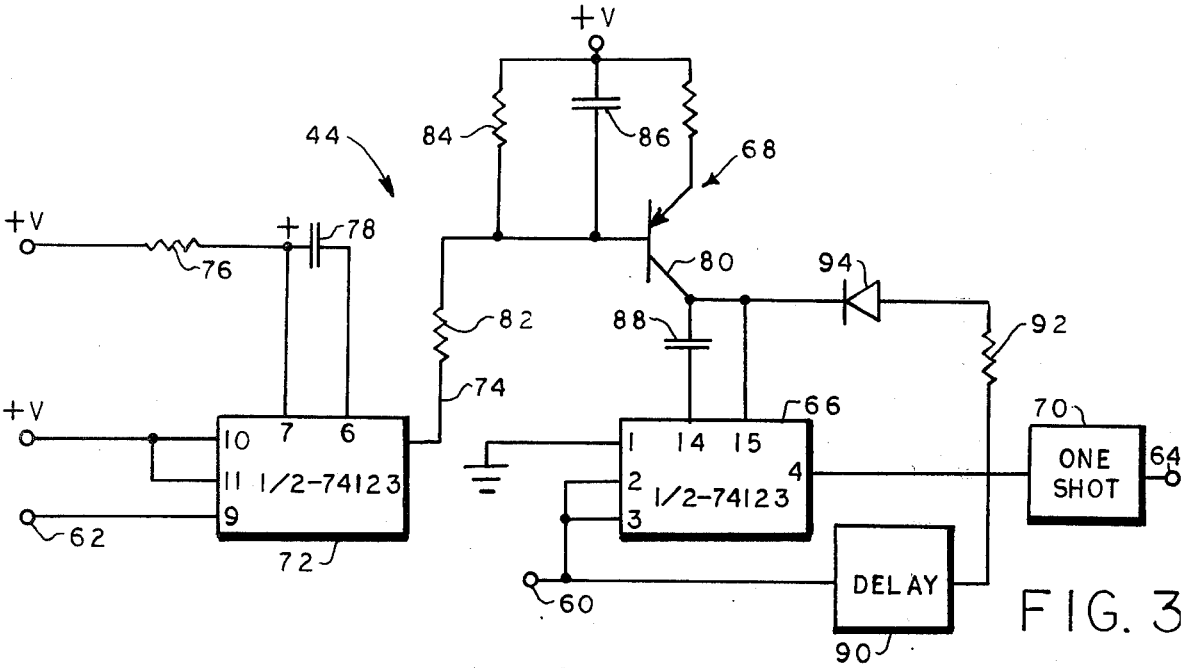
Figure 4:
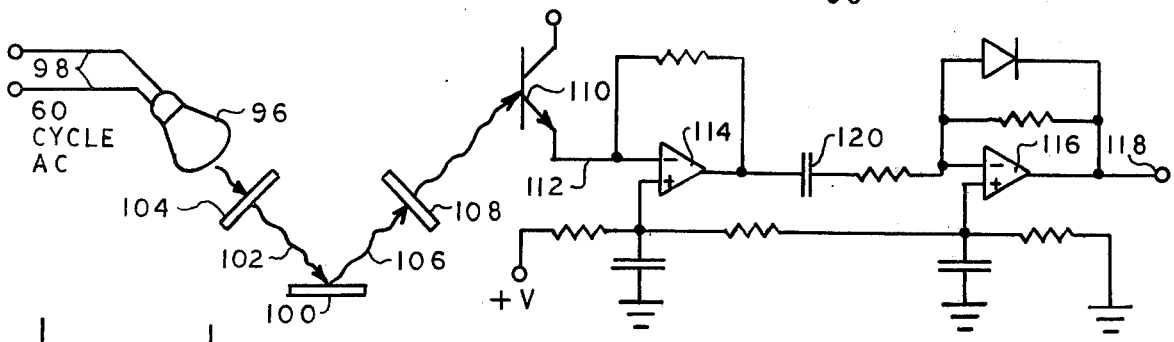
Figure 5A:
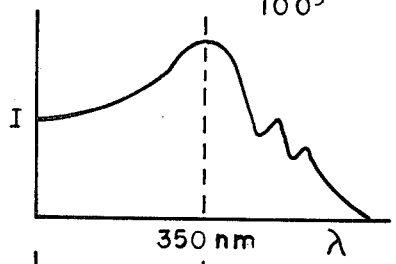
Figure 5B:
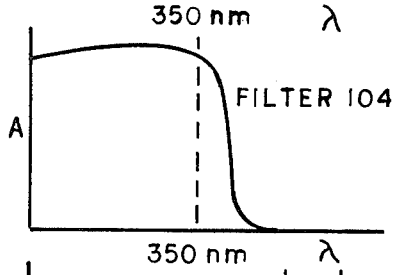
Figure 5C:
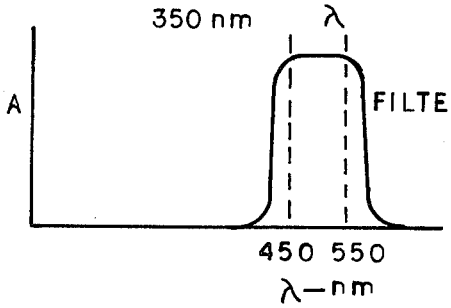
Figure 6:
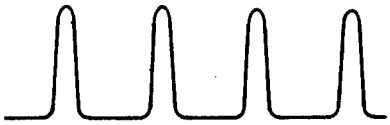
Figure 7:
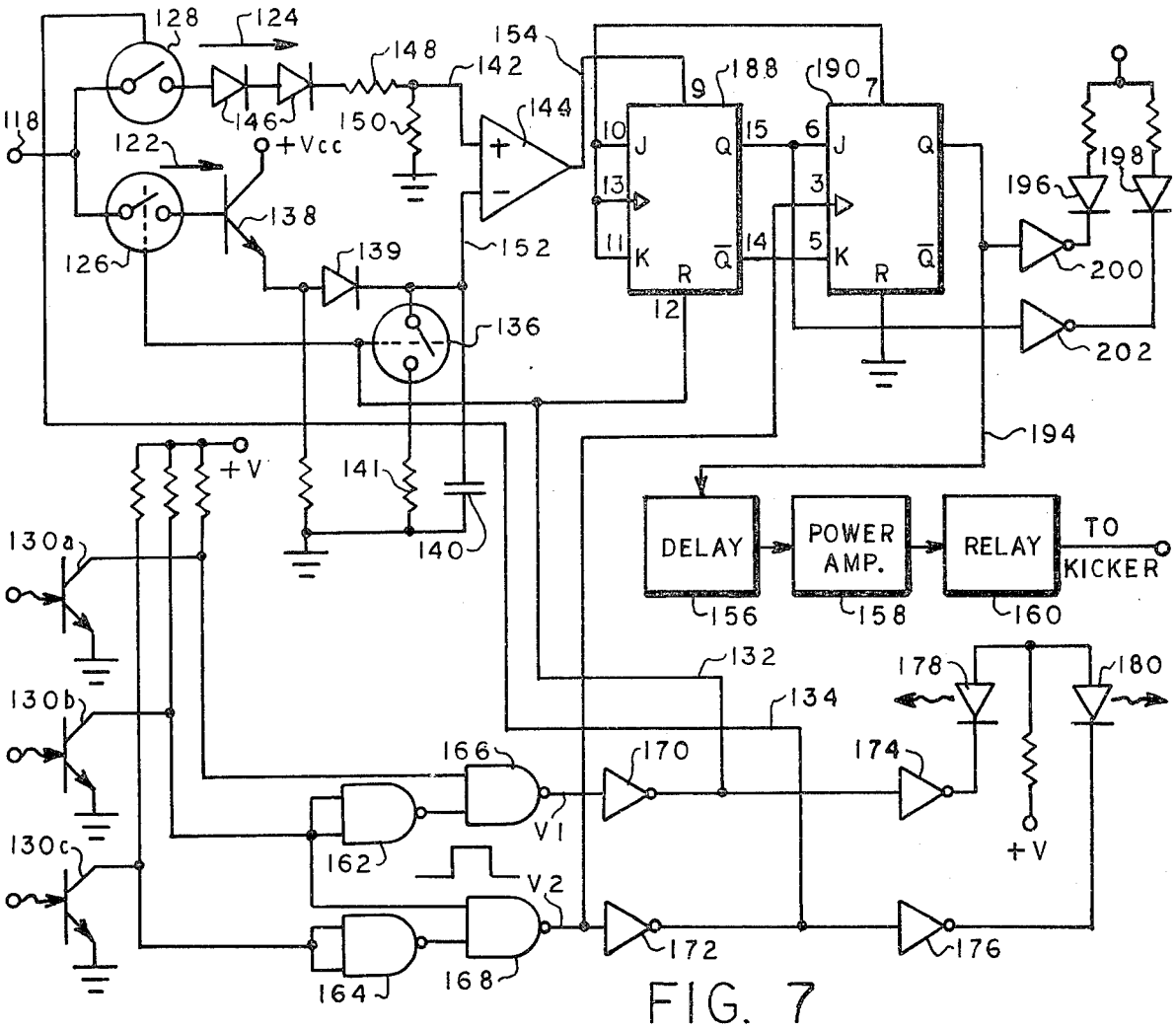
Figure 8A:
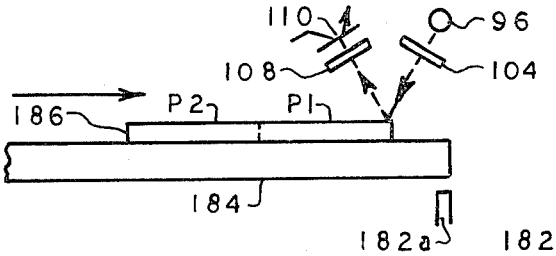
Figure 8B:
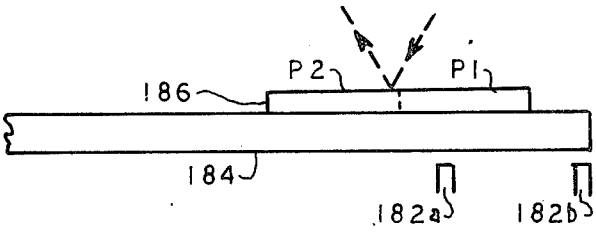
Figure 8C:
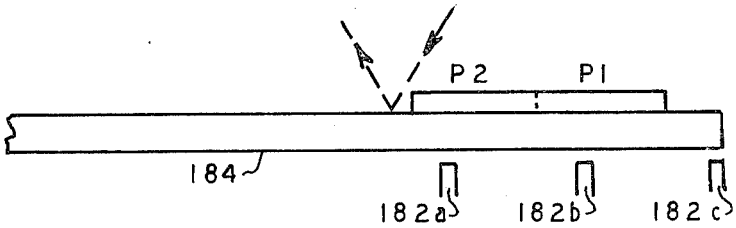
Figure 9:
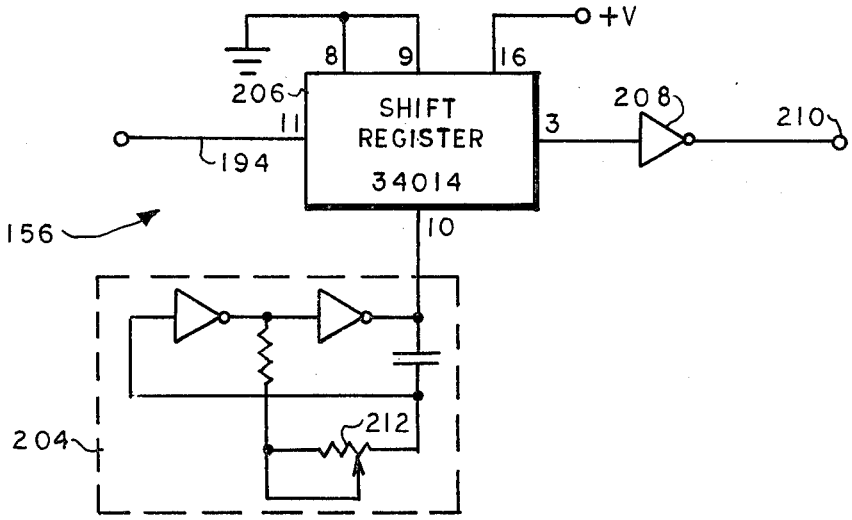
Figure 10:
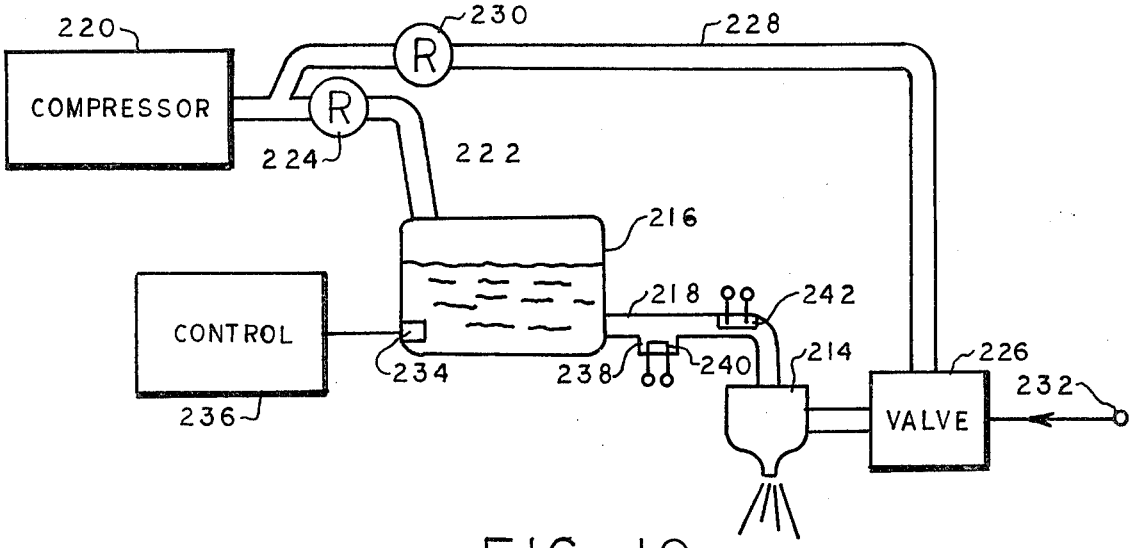
Figure 11:
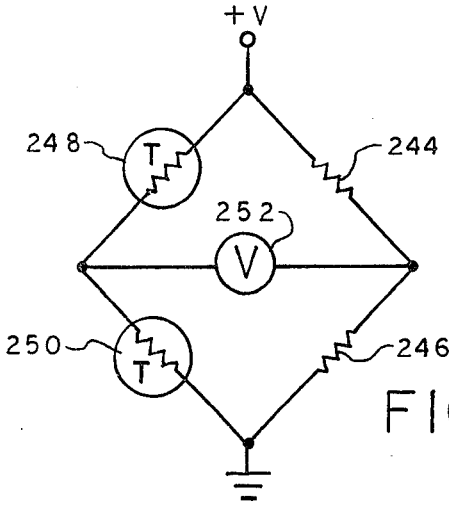

FIG. 3 schematically illustrates circuitry in accordance with this invention for synchronizing the actuation of a label coating applicator with the speed of a mailing piece conveyor;

FIG. 4 schematically illustrates a radiation detector for use with the mail sorting system of FIG. 1;

FIGS. 5A, 5B and 5C illustrate the operation of a radiation source and filters therefore associated with the radiation detector of FIG. 4;

FIG. 6 is a waveform useful in describing the operation of the radiation detector shown in FIG. 4;

FIG. 7 schematically illustrates circuitry for a label position sensor and a control responsive to the label position sensor for distinguishing a coated label from a non-coated label, all for use with the mail sorting system of FIG. 1;

FIGS. 8A, 8B and 8C schematically illustrate the operation of the label position sensor shown in FIG. 7;

FIG. 9 is a schematic diagram of an exemplary delay network for use with the apparatus shown in FIG. 7;

FIG. 10 schematically illustrates a label coating applicator, controls therefor, and means for detecting when the coating material is in short supply and/or not flowing freely; and FIG. 11 illustrates an exemplary control device for use with the apparatus of FIG. 9.

DESCRIPTION OF PREFERRED EMBODIMENT

The invention described herein is a mail sorting system in which an applicator is used to apply a radiation-emissive coating to labels which bear indicia representative of a zip code group. To differentiate labels which have been coated by the applicator from labels which are radiation-emissive by virtue of having been treated with a radiation-emissive dye during their manufacture, each label is treated herein as having at least two portions, one of which is a reference portion which is never coated and one of which is a coatable portion. When a label has been found to bear indicia representative of a new zip code group, only the coatable portion is coated by the applicator.

Mailing pieces bearing coated and non-coated labels are conveyed to a label position sensor which determines when a label is in position to be examined for a coating. When the reference portion of a label is positioned to be examined, the label position sensor generates a first signal to actuate a radiation detector. When the coatable portion of the label is positioned to be examined, the label position generator generates a second signal to again actuate the radiation detector. The radiation levels detected from the coatable and reference portions of the label are compared to determine if the two levels are different by at least a predetermined amount. If such a difference is detected, the mailing piece bearing that label is identified as one addressed to a new zip code area. Preferably, such identification is effected by actuating a kicker to displace the identified mailing piece so that an operator is given an easily observable indication that a mailing piece having a new zip code is being conveyed.

Two additional aspects of this invention are described herein, one for synchronizing the applicator with the speed of the conveyor so that the radiation-emissive coating is accurately deposited even when the conveyor speed changes, and one for detecting when the coating material used by the applicator is either in short supply or is not flowing freely through the applicator.

Figure 2:
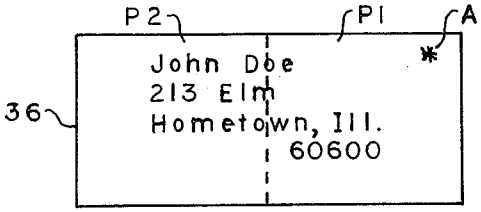
FIG. 2 illustrates an exemplary label bearing indicia representative of a zip code group for use with the mail sorting system of FIG. 1.

Turning now to FIG. 1, there is shown an exemplary mail sorting system in which various aspects of the invention are incorporated. The system may include conveyors 20, 22, and 24 for advancing mailing pieces 26 past a labeling station 28, an applicator station 30, a stuffing station 32, and a radiation detection station 34. At the labeling station 28, a supply of pre-printed address labels 36 are fed in a continuous web or sheet to a label head 38 for application of successive labels 36 to the mailing pieces 26. The labels 36 are preprinted with mailing addresses including zip code numbers as shown in FIG. 2, and are grouped according to zip codes for feeding to the label head 38. To identify the first label of each successive zip code group, an asterisk A or other indicia is printed on a margin area of each such label. A sensor head 40 and an associated time delay circuit, such as disclosed in U.S. Pat. No. 3,839,636 is positioned adjacent the input to the label head 38 for reading the sheet of labels 36 and to sense the presence of a label bearing an asterisk A. The applicator 42 may be a spray unit, a felt tipped pen, an ink roll, or a similar functionally equivalent device. The actuation of the applicator 42 is controlled by the sensor 40 and by a speed compensating device 44, the operation of the latter being described below.

As pointed out above, only a selected portion of a label bearing an asterisk is coated with a radiation-emissive substance. Such selective coating is achieved by positioning the applicator 42 to coat only a selected portion of a label so that the level of radiation emitted by the coated portion can be compared to the level of radiation emitted by a non-coating reference portion.

As shown in FIG. 2, each label is considered as having at least two portions, P1 and P2. If the label bears an asterisk, the applicator 42 coats only the portion P2, for example, and leaves the portion P1 uncoated. If the label does not bear an asterisk, neither portion of the label is coated. If substantially equal levels of radiation are subsequently detected from portions P1 and P2, the mailing piece bearing such a label will be treated as not being addressed to a new zip code area. If substantially different levels of radiation are detected from portions P1 and P2 of a label, the mailing piece bearing such a label will be treated as being addressed to a new zip code area. In this way, a non-coated label treated with a radiation-emissive dye is readily distinguished from a similarly treated label which has also been coated by the applicator 42.

After passing the applicator station 30, the mailing pieces 26 may be conveyed to an inserter 45 to insert or stuff the labeled mailing pieces into window-type envelopes, for example, so that the address on the label may be read through the envelope window W. Machines for this purpose are well known in the art and do not constitute a part of this invention.

The stuffed envelopes E are conveyed downstream of the inserter 45 to the radiation detection station 34 at which each envelope E is examined to determine whether its label has received a coating indicative of a new zip code area. Disposed at the radiation detection station 34 is a label position sensor 46 and a radiation detector 48. The label position sensor 46 generates a first position signal when a first portion such as portion P1 (FIG. 2) of a label is at the radiation detection station and generates a subsequent second position signal when a second portion such as portion P2 is at the radiation detection station. The first and second position signals are coupled to the radiation detector 48 via a lead 50 to actuate the radiation detector 48 whenever the corresponding first and second portions of a label are situated for detection. Thus, upon receipt of the first position signal, the radiation detector 48 is actuated and detects the level of radiation emitted by a portion P1 of a label. As an envelope E is conveyed further downstream, the radiation detector 48 is actuated by the second position signal and detects the level of radiation emitted by a portion P2 of the label. The two detected radiation levels are compared and, if the level from one portion is determined to be greater by at least a predetermined amount than the radiation level from the other portion, the envelope enclosing or bearing such a label is identified as having a label which has been coated by the applicator 42 and as being addressed to a new zip code area. Such identification is preferably made by coupling the output of the radiation detector 48 to a control circuit 52 for actuating a kicker 54 which, when actuated, displaces the identified envelope E as shown in dashed lines in FIG. 1. The control circuit 52 may also include a delay network for delaying the actuation of the kicker 54 until the identified envelope is adjacent the kicker.

Having described the functions of the various components of the FIG. 1 system in general terms, various components thereof will now be described more specifically. As pointed out above, the applicator 42 is controlled by both the asterisk sensor 40 and the speed compensator 44. The speed compensator 44 provides the applicator 42 with a control signal which is indicative of the speed of conveyance of the mailing pieces 26 to ensure that the applicator 42 accurately deposits the radiation-emissive substance on a label. Such control over the actuation of the applicator 42 takes into account the known travel time required for the radiation-emissive substance to leave the applicator 42 and arrive at a label. When the labeled mailing pieces 26 are being conveyed at very low speeds, such control is not critical because the travel time of the radiation-emissive substance is much shorter than the time spent by a label beneath the applicator 42. However, at high conveyor speeds, the travel time of the radiation-emissive substance becomes important. By varying the time at which the applicator 42 is actuated, compensation may be made for the travel time of the radiation-emissive substance.

To generate the required control signal, the speed compensator 44 receives from a speed indicator 56 a signal having a parameter which is indicative of the conveyor speed. The speed indicator 56 may include a slotted disc which rotates in synchronism with the conveyor as indicated at 58, a light source which is interrupted by the disc, and a photocell which receives the interrupted light. Such an indicator may be of the type shown in U.S. Pat. No. 3,839,636 and preferably generates a train of pulses whose number is proportional to the speed of the conveyor.

Turning now to FIG. 3, there is shown a preferred embodiment of the speed compensator 44. The illustrated speed compensator 44 is basically a pulse generator receiving a first signal input at an input terminal 60 and a second input signal at an input terminal 62. An output terminal 64 is provided for coupling a control pulse to the applicator 42 (FIG. 1).

The signal received at the input terminal 60 is generated by an asterisk sensor 40 and initiates the generation of a pulse by a multivibrator 66. That is, for each signal at terminal 60, a corresponding pulse is generated by multivibrator 66. However, the duration of each pulse generated by the multivibrator 66 is determined by a variable RC time constant network 68. As the condition of the time constant network changes, the duration of the pulse generated by the multivibrator 66 changes correspondingly. That is, the position of the trailing edge of the generated pulse varies in accordance with the control exerted by the time constant network 68.

The multivibrator 66 is coupled to a "one-shot" multivibrator 70 which is triggered by the trailing edge of the pulse generated by the multivibrator 66. Accordingly, the output of the multivibrator 70, appearing at output terminal 64, is a control pulse of constant width which begins at a point in time dictated by the input signal at terminal 60 and by the condition of the time constant network 68.

In order to vary the beginning of each control pulse at the output terminal 64, the condition of time constant network 68 is varied in accordance with the speed of the conveyor. This result is obtained by coupling to the time constant network 68 a train of pulses of constant duration and of a number which corresponds to the speed of the conveyor. The constant duration pulses are generated by a multivibrator 72 which receives from the input terminal 62 a train of pulses whose number is proportional to the speed of the conveyor, four pulses for each revolution of a rotary conveyor drive, for example. The latter pulses are generated by the speed indicator 56 (FIG. 1). For each pulse received from input terminal 62, the multivibrator 72 generates one pulse at lead 74, the duration of which is controlled by the time constant associated with a resistor 76 and a capacitor 78.

To convert the pulses at lead 74 to a time constant proportional to conveyor speed, the network 68 includes a transistor 80, an integrating network comprising resistors 82 and 84 and a capacitor 86, and a capacitor 88 coupled between the collector of transistor 80 and the multivibrator 66. In operation, the integrating network averages the pulses on lead 74 to develop a dc bias voltage for the transistor 80. The bias voltage thus obtained is proportional to the number of pulses received from lead 74 and, therefore, also proportional to the speed of the conveyor. The dc bias voltage is applied to the base of the transistor 80 for controlling its level of conduction. In the illustrated arrangement, the transistor 80 acts as a variable current source whose current output is dependent on conveyor speed. By coupling the transistor 80 in series with the capacitor 88, the capacitor 88 and the transistor 80 operate as a variable RC time constant for controlling the duration of the pulses generated by the multivibrator 66. Accordingly, the control pulses at the output terminal 64 are caused to be time-positioned in correspondence with the speed of the conveyor so as to compensate for the travel time of the radiation-emissive substance from the applicator 42 to the label being coated.

When mailing pieces are being conveyed at very slow speeds, one-tenth of an inch per second for example, the time constant network 68 cannot maintain its control condition because the capacitor 86 cannot maintain its charge for a long interval. Therefore, an additional control circuit, comprising a delay network 90, a resistor 92, and a diode 94, may be included for controlling the multivibrator 66 at very low speeds. As shown, the signal input at terminal 60 is coupled to the delay network 90 and thence through the resistor 92 and diode 94 to the capacitor 88 and to pin 15 of the multivibrator 66. The delay network 90 delays the signal from terminal 60 for an interval which allows a label which has been identified as bearing an asterisk to reach the applicator station 30. A similar delay network is shown in U.S. Pat. No. 3,839,636. The delay signal appearing at the output of the delay network 90 is coupled through the resistor 92 and the diode 94 to the multivibrator 66 for enabling it. Upon receipt of the delay signal from delay network 90 and the undelayed signal from input terminal 60, the multivibrator 66 generates an output pulse which triggers the one-shot 70, thereby actuating the applicator 42. Accordingly, the speed compensator 44 actuates the applicator 42 in co operation with the asterisk sensor 40 so that the applicator 42 is synchronized to the speed of the conveyed mailing pieces. This enables the applicator 42 to more accurately deposit a radiation-emissive substance on a label bearing an asterisk.

Referring now to FIG. 4, there is shown schematically a portion of the apparatus and circuitry associated with the radiation detector 48 (FIG. 1). The radiation detector preferably employs a source of ultraviolet radiation such as a lamp 96 whose power leads 98 are connected to a source of alternating current for amplitude modulating the output of the lamp 96.

A label 100 is shown in position to receive ultraviolet radiation 102 from the lamp 96, with a first filter 104 disposed between the lamp 96 and the label 100. The radiation 102 which impinges on the label 100 is partly absorbed and partly reflected by the label 100. When the label 100 has been either coated with a radiation-emissive substance by the applicator 42 or has been treated with a radiation-emissive dye during its manufacture, the label 100 will emit radiation 106 which passes through a second filter 108 and impinges on a radiation sensor, shown herein as a radiation-sensitive transistor 110.

Preferably, the lamp 96 emits radiation having a maximum radiation component of a first predetermined wavelength and in response thereto, the label 100 emits radiation of a second predetermined wavelength longer than the first predetermined wavelength. The filters 104 and 108 are selected such that the radiation 102 received by the label 100 is not transmitted to the transistor 110, whereas the radiation 106 emitted by the label 100 is transmitted thereto, thereby ensuring that the transistor 110 is responsive substantially only to the radiation emitted by the label 100. For example, the lamp 96 may be selected to generate ultraviolet radiation having a spectrum as shown in FIG. 5A wherein the maximum radiation component has a wavelength of approximately 350 nanometers (nm). The filter 104 is selected to be transmissive of the maximum radiation component and to be substantially non-transmissive to radiation components having longer wavelengths. As shown in FIG. 5B, the passband of the filter 104 includes 350 nm and excludes radiation of substantially longer wavelengths. As a result, the radiation 102 incident upon the label 100 will have no components whose wavelengths are substantially longer than 350 nm.

The radiation-emissive substance which the applicator 42 deposits on the label 100 is selected to respond to the incident radiation 102 by emitting radiation having a maximum component whose wavelength is longer than 350 nm, 450 nm, for example. In addition, the filter 108 is selected to be transmissive to radiation emitted by the radiation-emissive substance on the label 100 and non-transmissive to radiation of wavelengths substantially longer or shorter than 450 nm. FIG. 5C illustrates an exemplary passband for the filter 108 and shows that radiation of wavelengths between 450 nm and 550 nm are transmitted by the filter 108, shorter and longer wavelength radiation being substantially blocked. Accordingly, the radiation incident upon the transistor 110 includes the radiation emitted by the label 100 and excludes the radiation emitted by the lamp 96.

In response to incident radiation, the transistor 110 generates at its emitter 112 a signal which is proportional to the level of incident radiation. This signal is amplified by amplifiers 114 and 116 and coupled to a terminal 118 for further processing.

As shown, the amplifiers 114 and 116 are coupled by a capacitor 120 so as to pass only the AC component of the signal amplified by the amplifier 114. Amplifier 116 then generates at terminal 118 an output signal as shown in FIG. 6. Accordingly, by AC modulating the lamp 96, the radiation incident upon the transistor 110 includes corresponding AC components which may be amplified by the amplifier 116. Any DC components generated by drifts associated with the lamp 96, transistor 110, or from other sources are excluded from the output signal present at terminal 118.

The output signal developed at terminal 118 is representative of the radiation emitted by the label 100, including radiation emitted from portions P1 and P2 thereof (FIG. 2). In order to distinguish radiation emitted by virtue of radiation-emissive dye with which a label may have been treated from radiation emitted by virtue of a portion of a label having been coated by the applicator 42, the signal at terminal 118 is passed through one of two signal paths, depending on what portion of a label the radiation is emitted from.

To determine what portion of a label the incident radiation emanates from, the label position sensor 46 (FIG. 1) generates a first label position signal when radiation from a portion of a label such as portion P1 is being detected and a second label position signal when radiation from a portion of a label such as portion P2 is being detected. For purposes of explanation it is assumed that, if a label is to be coated by the applicator 42, the portion P2 will be the coatable portion and the portion P1 will be the uncoated or reference portion.

In response to a first label position signal indicating that radiation from a portion P1 of a label is being detected, the signal at terminal 118 is fed through a first signal path. In response to a second position signal indicating that radiation from a portion P2 of a label is being detected, the signal at terminal 118 is fed through a second signal path. The outputs of the two signal paths are then compared to determine if the level of radiation from portion P2 is greater by at least a predetermined amount than the level of radiation from portion P1. If such a difference is detected, the label whose radiation is being detected is assumed to be addressed to a new zip code area and the mailing piece or envelope bearing that label is displaced on the conveyor.

Referring now to FIG. 7, a first signal path for the signal of terminal 118 is indicated by the arrow 122 and the second signal path is indicated by the arrow 124. Switches 126 and 128 are serially coupled with paths 122 and 124, respectively, and respond to the first and second label position signals generated by the label position sensor 46 (FIG. 1) for coupling the signal at terminal 118 to paths 122 or 124.

The label position sensor 46 preferably includes a plurality of mailing piece edge sensors spaced from each other in the direction of feed of labeled mailing pieces. The spacing between the edge sensors is selected to be of a predetermined distance which is related to the size of the mailing piece, the size of a label and its position on a mailing piece so that, by detecting the edge of a mailing piece, the location of a label is also known. Thus, by successively sensing an edge of a conveyed mailing piece, an indication of the position of portions P1 and P2 of the associated label relative to the radiation detector is generated.

The label position sensor 46 preferably includes three edge sensors of the type disclosed in U.S. application Ser. No. 675,837, filed Apr. 12, 1976. Each sensor includes a photosensitive transistor upon which light is normally incident and each of which are disposed in the feed path of the mailing pieces so that the light normally incident upon the photosensitive transistors is blocked by a mailing piece conveyed between a photosensitive transistor and the source of light. Referring again to FIG. 7, three photosensitive transistors **130*a*, 130*b* and 130*c* are shown, each of which forms part of an edge sensor. In a manner to be more completely described below, the transistors 130*a*, 130*b* and 130*c* and their associated circuitry develop signals at leads 132 and 134 indicative of the position of a label relative to the radiation detector. Specifically, when a label is positioned so that the radiation emitted from its portion P1 is incident on the transistor 110 (FIG. 4), a first label position signal is developed at lead 132 for closing the switch 126 and thereby feeding the signal from terminal 118 to signal path 122. Concurrently with the closure of switch 126, another switch 136 closes in response to the label position signal on lead 132, the switch 128 and the signal path 124** remaining open.

When the switches 126 and 136 are closed, the signal at terminal 118 is coupled through an emitter follower transistor 138 and a diode 139 to a storage capacitor 140 and a resistor 141. The diode 139, the capacitor 140 and the resistor 141, together operate as a peak detector for charging the capacitor 140 with a charge representative of the peak value of the signal received from the terminal 118. Accordingly, the charge on capacitor 140 is representative of the peak value of the radiation emitted from the uncoated or reference portion P1 of a label. This charge is maintained on the capacitor 140 by the switch 136 opening when the signal on lead 132 indicates that the portion P1 of the label has passed the radiation detector, thereby removing the resistor 141 from the circuit. At that time the switch 126 also opens, thereby disconnecting the signal path 122 from the terminal 118.

When a label is positioned such that the radiation from its portion P2 is incident on the transistor 110, a second position signal is developed at lead 134 for closing the switch 128. Concurrently therewith, switches 126 and 136 are opened. Upon this occurrence, the signal at terminal 118 is coupled to an input 142 of a comparator 144 via diodes 146 and voltage dividing resistors 148 and 150. The diodes 146 are provided to equalize the dc voltage drops in path 124 with similar voltage drops in path 122. The resistors 148 and 150 are included to provide the comparator 142 with a signal input which is a fixed percentage, 60 percent, for example, of the signal level at terminal 118.

The comparator 144 now receives at its input 142 a signal representative of a percentage of the level of radiation received from a portion P2 of a label. At another input 152 the comparator 144 receives from the capacitor 140 a signal representative of the peak value of radiation emitted from the portion P1 of the same label.

When the signal level at input 142 exceeds the signal level at input 152, the comparator 144 develops at its output lead 154 an identification signal which identifies the detected label as one which bears an asterisk.

The identification signal at lead 154 is used to actuate flip-flops 188 and 190 for actuating the kicker 54 (FIG. 1) via a delay network 156, a power amplifier 158 and a relay 160. The delay network 156 delays the actuation of the kicker 54 until the mailing piece bearing the identified label is adjacent the kicker 54.

Because of the voltage dividing resistors 148 and 150, the signal representative of the level of radiation emitted from a portion P2 of a label must be greater by a predetermined amount than the signal representative of a level of radiation emitted from a portion P1 of the same label. Therefore, if the label has been treated with a radiation-emissive dye but no portion thereof has been coated by the applicator 42, it is very unlikely that the signals received by the comparator 144 will differ by an amount great enough to cause an identification signal to be generated. However, if the portion P2 has been coated, the level of radiation therefrom will cause the signal at the input 142 of the comparator 144 to exceed the signal level at the other input 152 and the identification signal will be generated. Accordingly, this system can readily distinguish between labels which are radiation-emissive as a result of their being merely treated with a dye and those labels which have been coated to identify them as belonging to a new zip code group.

Turning now to a consideration of how the transistors **130*a*, 130*b*, and 130*c* and their associated circuitry develop the first and second label position signals at leads 132 and 134, respectively, it is assumed that each such transistor is ON when light is incident thereon and each is OFF when an edge of a mailing piece blocks light therefrom. The transistors are connected as shown to four Nand gates 162, 164, 166 and 168. The outputs of Nand gates 166 and 168 are coupled to inverters 170 and 172, respectively, the latter being connected to another pair of inverters 174 and 176. The outputs of the inverters 170 and 172 constitute the first and second label position signals at leads 132 and 134, respectively. The inverters 174 and 176 drive light emitting diodes 178 and 180 for generating a visual indication of the condition of the signals at leads 132 and 134 for aligning the transistors 130*a*, 130*b*, and 130*c*** in the path of feed of the mailing pieces.

The operation of the logic circuitry receiving the signals from transistors **130*a*, 130*b*, and 130*c* is most easily described with reference to FIG. 8 wherein three edge sensors 182*a*, 182*b*, and 182*c* represent the edge sensors associated with the transistors 130*a*, 130*b*, and 130*c*, respectively. As shown, the edge sensors are located in the path of feed of a mailing piece 184 bearing a label 186. The label 186 has portions P1 and P2 which receive radiation from the lamp 96 and which may emit radiation to the transistor 110**.

When the mailing piece 184 is conveyed in the direction of the arrow and reaches the position indicated in FIG. 8A, the sensor **182*a* senses the leading edge of the mailing piece 184. As a result, the transistor 130*a* (FIG. 7) turns off and a high logic level is developed at lead 132, thereby activating switches 126 and 136 and coupling the signal path 122 to the terminal 118. Because the sensor 182*a* is positioned to sense the edge of the mailing piece 184 when the radiation from portion P1 of the label 186 is being received and detected, the signal coupled to the signal path 122** is representative of the level of radiation from portion P1.

The signal path 122 remains coupled to terminal 118 until the mailing piece 184 advances to the position shown in FIG. 8B, whereupon the sensors **182*a* and 182*b* are both actuated and the radiation from the portion P2 of the label is detected. Now transistors 130*a* and 130*b* are off both, a low logic level is developed at lead 132 and a high logic level is developed at lead 134. As a result, the signal path 122 is decoupled from terminal 118, the signal path 124 is coupled to terminal 118, and a signal representative of the level of radiation from portion P2 is coupled to the comparator 144. The signal path 124 remains coupled to terminal 118 as long as sensors 182*a* and 182*b* remain actuated. If the comparator 144 now detects that the signal at input 142 is greater in amplitude than the signal at input 152, it will generate an identification signal at its output lead 154** and the kicker will be activated for displacing the identified mailing piece.

The detection of radiation from portion P2 continues until the mailing piece 184 reaches the position indicated in FIG. 8C. At this time, a sensor **182*c* is actuated, as well as the sensors 182*a* and 182*b*. The simultaneous actuation of the sensors 182*a*, 182*b* and 182*c* results in low logic levels being developed at leads 132 and 134, whereupon the switch 128 is opened to decouple the signal path 124 from terminal 118. Switches 126 and 136 remain open and the system will remain in that condition until the next successive mailing piece activates the sensor 182*a*.** Then the cycle repeats as described above.

As noted above, the switch 128 was closed in response to the mailing piece 184 arriving at the position shown in FIG. 8B. When this occurred, lead 132 carried a low logic level, which level is coupled to the flip-flop 188 to permit it to be "set" should the comparator 144 generate an identification signal. Assuming that such an identification signal has been generated, the set condition of the flip-flop 188 is transferred to a flip-flop 190 by virtue of a high logic level appearing on a lead 192 when the mailing piece 184 arrives at the position shown in FIG. 8C. Upon the flip-flop 190 becoming set, a signal is coupled via a lead 194, the delay network 156, the power amplifier 158, and the relay 160 to the kicker. The flip-flop 188 is reset by the next high logic level which appears on lead 132 and occurs when the next succeeding mailing piece arrives at the location illustrated in FIG. 8A.

To properly set up the system to detect radiation from portions P1 and P2 of a label, it is preferable that the sensors **182*a*, 182*b*, and 182*c* (FIG. 8) be movable so that different size mailing pieces, labels, and label positions on the mailing pieces may be accommodated. In aligning the sensors, an operator need merely observe the light emitting diodes 178 and 180 for assurance that the sensors are situated as indicated in FIG. 8** so that actuation of the various sensors occurs when the radiation from a desired portion of a label is being detected.

Another pair of light emitting diodes 196 and 198 may be coupled to the flip-flops 188 and 190 through a corresponding pair of inverters 200 and 202 as shown to generate a visual indication of the condition of the flip-flops 188 and 190. Thus, an operator can determine whether or not the kicker is being actuated at the correct time.

The delay network 156 may take on a variety of forms well known in the art. One embodiment thereof which has been found to be acceptable is illustrated schematically in FIG. 9. As shown, the delay network may comprise an oscillator 204 driving a shift register 206, the output of the latter being coupled to an inverter 208 and thence to terminal 210. The terminal 210 is coupled to the input to the power amplifier 158 (FIG. 7). The shift register 206 is coupled to the flip-flop 190 via lead 194.

The oscillator 204 and the shift register 206 co-operate in a manner well known in the art to couple a signal from lead 194 to terminal 210 after a delay interval determined by the frequency of oscillation of the oscillator 204. To conform the delay to that required by a particular environment, a variable resistor 212 is included as a part of the oscillator 204. Varying the value of the resistor 212 varies the frequency of oscillation of the oscillator 204 and the delay imparted to signals received from lead 194.

In the case where the applicator 42 (FIG. 1) is adapted to spray a liquid coating material onto a label, it is preferable that means be included for generating an indication of when the supply of liquid coating material is low in order that the system can be shut down, if desired, to replenish the supply before it is completely exhausted. Otherwise, labels bearing an asterisk may leave the coating station without having been coated and will therefore not be identified as being addressed to a new zip code area. In addition, it is also preferred that the system include means for detecting when the liquid coating material is not flowing freely to the applicator from a reservoir for the material. If free flow of the coating material is not occurring as a result of an applicator nozzle being clogged, for example, an operator should be given an indication of that condition so that the system can be shut down and the condition remedied.

These latter aspects of the invention are illustrated in FIG. 10 wherein a nozzle 214 is included for spraying liquid coating material on a label. The nozzle 214 receives liquid coating material from a reservoir 216 via a conduit 218. A compressor 220 supplies air under pressure to the reservoir 216 via a pipe 222 in which a regulator 224 is situated, the air pressure causing the liquid coating material to flow under pressure to the nozzle 214. To actuate the nozzle 214, a valve 226 receives air under pressure from the compressor 220 via a pipe 228 in which another regulator 230 is situated. The valve responds to a control signal at a terminal 232 for admitting air under pressure to the nozzle 214 for spraying the liquid coating material on a label.

To generate an indication of a low fluid level in the reservoir 216, a heat sensitive device 234 is disposed at a selected distance from the bottom of the reservoir 216 for generating an indication of a low level of liquid coating material in the reservoir 216. The heat sensitive device is preferably one which is cooled by the liquid coating material when the level thereof is at or above the level at which the device 234 is situated and which rises to an elevated temperature when the level of the liquid coating material is below the level of the heat sensitive device 234. This effect is readily achieved by using a thermister as the heat sensitive device 234 and coupling the thermister to a control 236 which responds to the temperature-induced resistance changes in the thermister. The control 236 may generate an audio or visual alarm to alert an operator of a detected low fluid level and/or shut down the system.

To generate an indication that the liquid coating material is or is not flowing freely in the conduit 218, the conduit preferably includes a well 238 for holding a small supply of non-flowing liquid coating material. Inside the well 238 a heat sensitive device 240 such as a thermister is situated for generating a signal representative of the temperature of the thermister. Because the liquid coating material in the well 238 is not flowing the temperature of the heat sensitive device 240 is at a relatively high level.

Another heat sensitive device 242 such as a thermister is situated in the conduit 218 and in the path of flow of the liquid coating material. Because the device 242 is normally contacting flowing material, it is somewhat cooled thereby. Thus, the temperature of the heat sensitive device 242 is normally lower than the temperature of the heat sensitive device 240. The outputs of the devices may be connected to a well known type of control for detecting the temperature-induced differences in the devices 240 and 242 and for generating an indication that the liquid coating material is flowing freely through the conduit 218.

Should free flow be inhibited, the temperature of the device 242 will approach the temperature of the device 240 and the control to which the devices 240 and 242 are connected will generate an indication that the liquid coating material is not flowing freely through the conduit 218.

Referring now to FIG. 11, there is shown a control of the type to which the heat sensitive devices 240 and 242 may be connected. As shown, the control is a bridge network having a pair of fixed value resistors 244 and 246 and a pair of thermisters 248 and 250. The thermisters 248 and 250 correspond to the heat sensitive devices 240 and 242 of FIG. 10. To detect the temperature-induced resistance changes in the thermisters 248 and 250, a voltmeter 252 is coupled across the bridge network. The voltmeter may thus generate an indication of imbalance or balance in the bridge to indicate a flow or lack thereof in the conduit 218. Alternately, the inputs to the voltmeter may be coupled to an audio or visual alarm and/or a control for shutting down the system when a lack of flow is detected.

The mail sorting system described above has a number of advantages over prior systems. For example, by coating and detecting only a selected portion of a label bearing an asterisk, such a label is readily distinguished from a label which is not coated and which is radiation-emissive by virtue of having been previously treated with a radiation-emissive dye. In addition, the radiation-emissive substance is more accurately deposited on a label because the applicator is controlled by a speed compensating device which more accurately synchronizes the applicator with the speed of conveyance of labels and their associated mailing pieces. Further, when the applicator takes the form of a spray nozzle, the level of available coating material for the spray nozzle and the flow thereof to the nozzle are conveniently sensed by the described apparatus.

While the various aspects of the invention have been described with reference to specific exemplary structure, many alterations, modifications and variations will be apparent to those skilled in the art in light of this disclosure. Accordingly, it is intended to embrace all such alterations, modifications and variations which fall within the spirit and scope of this invention as defined by the appended claims.

What is claimed is:

1. In a mail sorting system in which preaddressed labels are grouped according to zip codes and applied to mailing pieces moving along a feed path, and in which selected labels bear indicia representative of a zip code group, a system for sorting mailing pieces according to zip code groups and in which each label is treated as having a coatable portion and a reference portion, said system comprising:

an applicator responsive to the zip code group indicia on a label for applying a radiation-emissive coating on the coatable portion of the label;

a label position sensor disposed in the feed path of mailing pieces and downstream of said applicator for generating a first label position signal when the reference portion of each label is at a radiation detection station and for generating a second label position signal when the coatable portion of each label is at the radiation detection station;

a radiation detector disposed at the radiation detection station for detecting radiation from the reference and coatable portions of each label in response to said first and second label position signals, respectively; and means responsive to said radiation detector for comparing the difference in the detected levels of radiation from the coatable and reference portions of each label and for identifying a mailing piece bearing a label from whose coatable and reference portions at least a predetermined difference in radiation is detected by virtue of the coatable portion thereof having been coated by said applicator, whereby each mailing piece bearing a label having a coated portion is identified as one whose label bears indicia representative of a zip code group.

2. A system as set forth in claim 1 wherein said label position sensor includes a plurality of mailing piece edge sensors spaced from each other in the direction of feed of labeled mailing pieces by a predetermined distance related to the size of a label and its position on a mailing piece so that the successive sensing of an edge of a labeled mailing piece by said edge sensors generates an indication of the position of the label relative to the radiation detection station.

3. A system as set forth in claim 1 including means situated at a label sensing station for sensing the zip code indicia on a selected label;

a conveyor for advancing labeled mailing pieces along a feed path from said label sensing station to said applicator; and means responsive to the speed of the conveyor for synchronzing the actuation of said applicator with the speed of said conveyor, whereby when said conveyor advances the mailing pieces at different speeds between the label sensing station and said applicator, said application is actuated only when a mailing piece bearing a selected label is properly positioned with respect to said applicator.

4. A system as set forth in claim 1 wherein said applicator includes a nozzle for spraying liquid coating material on selected labels, a reservoir coupled to said nozzle for supplying the liquid coating material to the nozzle, and a heat sensitive device disposed in said reservoir and at a selected distance from the bottom of the reservoir for generating an indication of a low level of liquid coating material in the reservoir, said heat sensitive device being cooled by the liquid coating material when the level thereof is above said predetermined level and being at an elevated temperature when the level of the liquid coating material is below said predetermined level.

5. A system as set forth in claim 4 including a conduit for transmitting the liquid coating material from said reservoir to said nozzle, said conduit having a well therein in which non-flowing liquid coating material is contained, a first heat-senstive device disposed in the well, a second heat-sensitive device disposed in the conduit and in the path of flow of the liquid coating material, and means for detecting the difference in temperature between said first and second heat-sensitive devices, whereby when the liquid coating material flows freely through the conduit, said second heat-sensitive device is cooled, but when the liquid coating material is not flowing in said conduit, the temperature of said second heat-sensitive device approaches the temperature of said first heat-sensitive device and said detecting means detects the correspondence in the temperature of said first and second heat-sensitive devices as an indication that the liquid coating material is not flowing in the conduit.

6. A system as set forth in claim 1 wherein said radiation detector includes a radiation sensor disposed to receive radiation from each label and for generating an output signal indicative of the level of received radiation;

a first signal path for receiving the output signal in response to said first position signal;

a second signal path for receiving the output signal in response to said second position signal, said first and second signal paths being coupled between said radiation sensor and said comparing and identifying means, whereby the radiation from said reference and coatable portions of each label is differentiated by virtue of its being coupled through separate signal paths.

7. A system as set forth in claim 6 wherein said radiation detector further includes:

a source of ultraviolet radiation having a maximum radiation component of a first predetermined wavelength for irradiating labels which, when coated and irradiated by said source, emit radiation of a second predetermined wavelength longer than said first predetermined wavelength;

a first filter situated between said radiation source and an irradiated label, said first filter being transmissive to radiation of said first predetermined wavelength and substantially non-transmissive to radiation of wavelengths longer than said first predetermined wavelength; and a second filter disposed between the irradiated label and said radiation sensor, said second filter being transmissive to radiation of said second predetermined wavelength and substantially non-transmissive to radiation of wavelengths substantially shorter and longer than said second predetermined wavelength, whereby said radiation sensor receives the radiation emitted by an irradiated label but the radiation emitted by said radiation source is substantially excluded therefrom.

8. A system as set forth in claim 7 including means for AC modulating said radiation source for providing its radiation and the radiation emitted by a label with an AC component so that the output signal from said radiation sensor may be amplified by an AC amplifier and more readily distinguished from extraneous DC drifts associated with the radiation detector.

9. A system as set forth in claim 6 wherein said comparing and identifying means includes:

a comparator having a first input coupled to said first signal path and having a second input coupled to said second signal path, said comparator generating an identification signal in response to the output signals from said first and second signal paths having at least a predetermined difference between their amplitudes; and a kicker responsive to said identification signal for displacing a mailing piece bearing a label whose coatable and reference portions emit radiation of levels different by at least said predetermined difference.

10. A system as set forth in claim 9 including a delay network situated between said comparator and said kicker for delaying the identification signal for a predetermined interval, whereby said kicker is actuated after a predetermined interval following the generation of said identification signal to permit the mailing piece which is to be displaced to be conveyed to said kicker at the time when said kicker is actuated.

11. In a mail sorting system in which preaddressed labels are grouped according to zip codes and applied to mailing pieces moving along a feed path, and in which selected labels bear indicia representative of a zip code group, a system for sorting mailing pieces according to zip code groups comprising:

means for applying a radiation-emissive coating on a first of two portions of a label bearing indicia representative of a zip code group;

a label position sensor comprising three mailing pieces edge sensors disposed in the feed path of mailing pieces downstream of said applying means and separated from each other in accordance with the size of the mailing pieces, the size of the labels and the position of the labels on the mailing pieces for generating a first label position signal when the first portion of each label is at a radiation detection station and a second label position signal when the second portion of each label is at the radiation detection station;

a radiation detector disposed at the radiation detection station for detecting radiation emitted from the first and second portions of each label and for generating at an output a radiation signal representative of the level of detected radiation;

a first signal path having an input and an output;

a second signal path having an input and an output;

means responsive to said first label position signal for coupling the input of said first signal path to the output of said radiation detector;

means responsive to said second label portion signal for coupling the input of said second signal path to the output of said radiation detector;

a comparator receiving the outputs of said first and second signal paths for generating an identification signal when the radiation signal received from said first signal path is greater than the radiation signal received from said second signal path; and means responsive to said identification signal for displacing the mailing piece bearing the label from which the identification signal was generated.

12. A system as set forth in claim 11 wherein said first signal path includes means for storing therein a signal representative of the radiation signal received from said radiation detector.

13. A system as set forth in claim 12 wherein said storing means includes a peak detector.

* * * * *